US005927126A

United States Patent [19]

Biella

[11] Patent Number: 5,927,126

[45] Date of Patent: Jul. 27, 1999

[54] BENDING MACHINE FOR BENDING WIRE-LIKE MATERIAL, SUCH AS PIPES, RODS OR SECTION MEMBERS

[75] Inventor: Marioalberto Biella, Seregno, Italy

[73] Assignee: BLM S.P.A., Cantu, Italy

[21] Appl. No.: 09/040,964

[22] Filed: Mar. 18, 1998

[30] Foreign Application Priority Data

Mar. 21, 1997 [IT] Italy ..... MI97A0644

[51] Int. Cl.[6] ..... B21D 7/025; B21D 43/20

[52] U.S. Cl. ..... 72/149; 72/307; 72/424

[58] Field of Search ..... 72/307, 306, 149, 72/157, 159, 153, 158, 217, 388, 424

[56] References Cited

U.S. PATENT DOCUMENTS

| | | | |
|---|---|---|---|
| 3,339,391 | 9/1967 | Kowalski | 72/153 |
| 4,485,658 | 12/1984 | Stewart et al. | 72/149 |
| 4,662,204 | 5/1987 | Saegusa | 72/306 |
| 4,941,338 | 7/1990 | Spath | 72/153 |
| 5,010,758 | 4/1991 | Togoshi | 72/157 |
| 5,113,683 | 5/1992 | Lafrasse | 72/217 |
| 5,263,350 | 11/1993 | Crippa | 72/157 |

FOREIGN PATENT DOCUMENTS

| | | |
|---|---|---|
| 0 417 703 | 3/1991 | European Pat. Off. . |
| 0446 819 | 9/1991 | European Pat. Off. . |
| 15 27 394 | 12/1969 | Germany . |

*Primary Examiner*—Daniel C Crane
*Attorney, Agent, or Firm*—Darby & Darby

[57] ABSTRACT

A bending machine (1) for bending wire-like material, such as pipes, rods or section members, comprises a machine bed (2) supporting a carriage provided with a gripper (10) for controllably turning and translating a workpiece, and a curving head (50) which is supported by a translating slide (20) operatively coupled with controllable driving means, the translating slide (20) being supported by a table (25) having a supporting shaft (35) which is rotatably housed in the machine bed, and is operatively coupled to controllable driving means.

6 Claims, 5 Drawing Sheets

BENDING MACHINE FOR BENDING WIRE-LIKE MATERIAL, SUCH AS PIPES, RODS OR SECTION MEMBERS

CROSS REFERENCE TO RELATED APPLICATION

The present invention is related to U.S. patent application Ser. No. 09/040,962 entitled "Bending Machine for Bending Wire-like Material, Such as Pipes, Rods or Section Members", filed on Mar. 18, 1998.

BACKGROUND OF THE INVENTION

The present invention relates to a bending machine for bending wire-like material, such as pipes, rods, or section members, comprising a machine bed supporting a carriage, having a gripper for controllably turning and translating a workpiece, and a bending head.

As is known, wire-like material, for example pipes for carrying fluids, vapors or gases to system devices, has sometimes a very complex configuration.

Such a complex configuration is required for fitting the wire-like material to the communicating path arrangements communicating the devices to be connected.

This wire-like material is preliminarily made in the form of rods or pipes, either of straight configuration or wound into coils.

These rods or coils are cut in portions having a desired length and then are bent by suitably designed bending machine.

Known bending machines comprise a machine bed supporting, on a plate, a carriage including a gripper and a slide having a bending head.

The gripper is so designed as to grip the rod or pipe length and to displace and turn this length along the axis thereof.

The slide is so coupled to the machine bed that it is possible to adjust the position of said slide transversal of the gripper by small rectilinear displacements.

This prior bending machine allows to align a die, provided on the bending head, with the axis of the rod or pipe length, in order to engage this length in the die for bending it.

The provision of a device for driving the slide transversely of the gripper greatly increases the size of these prior bending machines laterally of the gripper.

Such an enlarged size of the bending machine limits the desired spatial extensions of the lengths to be bent. This large size, moreover, increases the machining time, since the workpiece, during the machining thereof, must be re-oriented in order to prevent the workpiece from colliding against portions of the bending machine, during the bending operation.

At present, the mentioned bending machines are also associated with handling devices, such as handling robots, in order to automatically supply and unload the workpiece, or transfer it to other machining units.

The control, i.e. the programming, of the mentioned handling units, is very difficult.

Such a handling and, in particular, an accurate handling of the workpiece, on the other hand, is necessary as a great processing or machining speed is desired.

Moreover, the bent length must not disorderly fall to the bottom of the bending machine, as it is disengaged from the bending arm. In particular, the machined workpiece must not fall onto components of said machine thereby preventing subsequent machining operations, or it must not be affected, upon falling, by unknown deformations susceptible to spoil the proper quality of the product.

Furthermore, the provision of a handling unit for automatizing the workpiece loading and unloading operations, makes the use of the bending machine much more difficult and expensive, as the bending machine pertains to an automatic making line, in which other machining operations are also performed, such as butting, marking, threading, drilling operations, as well as in which coupling nut engaging stations are furthermore provided.

SUMMARY OF THE INVENTION

Accordingly the main object of the present invention is to overcome the above mentioned drawbacks of the prior art and, in particular, to allow the rod, section member or pipe lengths to be handled without using additional handling units, for example for supplying and unloading the workpieces to/from the bending machine, while providing a construction-wise simple bending machine including a small number of driving axes, so as to reduce the lateral size of the bending machine in order to facilitate the machining of large and complex configuration.

Another object of the invention is to allow the bending machine to carry out several machining operations.

The objects of the invention are achieved by a bending machine for bending wire-like material, such as pipes, rods or section members, comprising a machine bed supporting a carriage provided with a gripper for controllably turning and translating a workpiece, and a bending head, characterized in that the bending head is supported by a translating slide operatively coupled to controllable driving means, that the translating slide is supported by a supporting table having a supporting shaft rotatably housed in the machine bed, and that the supporting shaft is operatively coupled to controllable driving and locating means.

In order to further increase the processing speed of the head, the supporting shaft is supported by a translating carriage housed in the machine bed and operatively coupled with driving and control means.

For translating or driving the slide on the table, the latter is provided with slide translating guides and a driving screw coupled to a servomotor, the driving screw being operatively coupled to a nut screw rigid with the slide.

In order to turn the table on the machine bed, the shaft extends from said table, supporting and turning means coupling said shaft to the machine bed, and a turning adjusting means being coupled to the shaft.

In order to rotatively drive the table, a servo-aided geared motor is supported by the machine bed, the shaft supporting a gear wheel, said geared motor being coupled to said gear wheel by a pinion.

In order to carry out several machining operations on the workpiece gripped by the gripper, a plurality of machining units are supported by the slide.

The advantages of the present invention mainly consist of a possibility of directly handling, by the head provided on the bending machine slide, the rod and pipe lengths, by allowing the workpieces to be automatically supplied to, and unloaded from, the bending machine without the need of using specifically designed handling units, thereby reducing the machining time. In particular, the automatic unloading of the workpieces machined by the bending head allows, without the provision of any handling units, to prevent the pipes from disorderly falling to the bottom of the bending machine or on components thereof.

A further advantage of the invention is the possibility of easily bending complex and large size workpieces, owing to the reduced transversal size of the machine and the turning of the head thereof.

The use of the head as a workpiece handling axis, allows to increase the machining speed of the machine. In fact, it is possible to exploit the operating positions of the bending arm provided on the mentioned head, in order to bring the workpiece to other machining units, such drilling, butting, threading or marking units, as well as nut loading stations or other loading and unloading stations.

Owing to the turning capability of the bending machine slide, it can support several rod or pipe length machining units provided for cooperating with the gripper.

For example, it is possible to provide opposite left and right bending heads, or a bending head and a butting unit.

A further advantage, deriving from the capability of handling the workpiece by the head, is that, during the machining, it is possible to reverse the end of the pipe or rod length gripped by the gripper, thereby allowing to perform much complex bending arrangement.

BRIEF DESCRIPTION OF THE DRAWINGS

The subject matter of the present invention will be disclosed and illustrated hereinafter in a more detailed manner by an exemplary embodiment thereof, with reference to the accompanying drawings, where.

DESCRIPTION OF THE PREFERRED EMBODIMENTS

Figure 1:
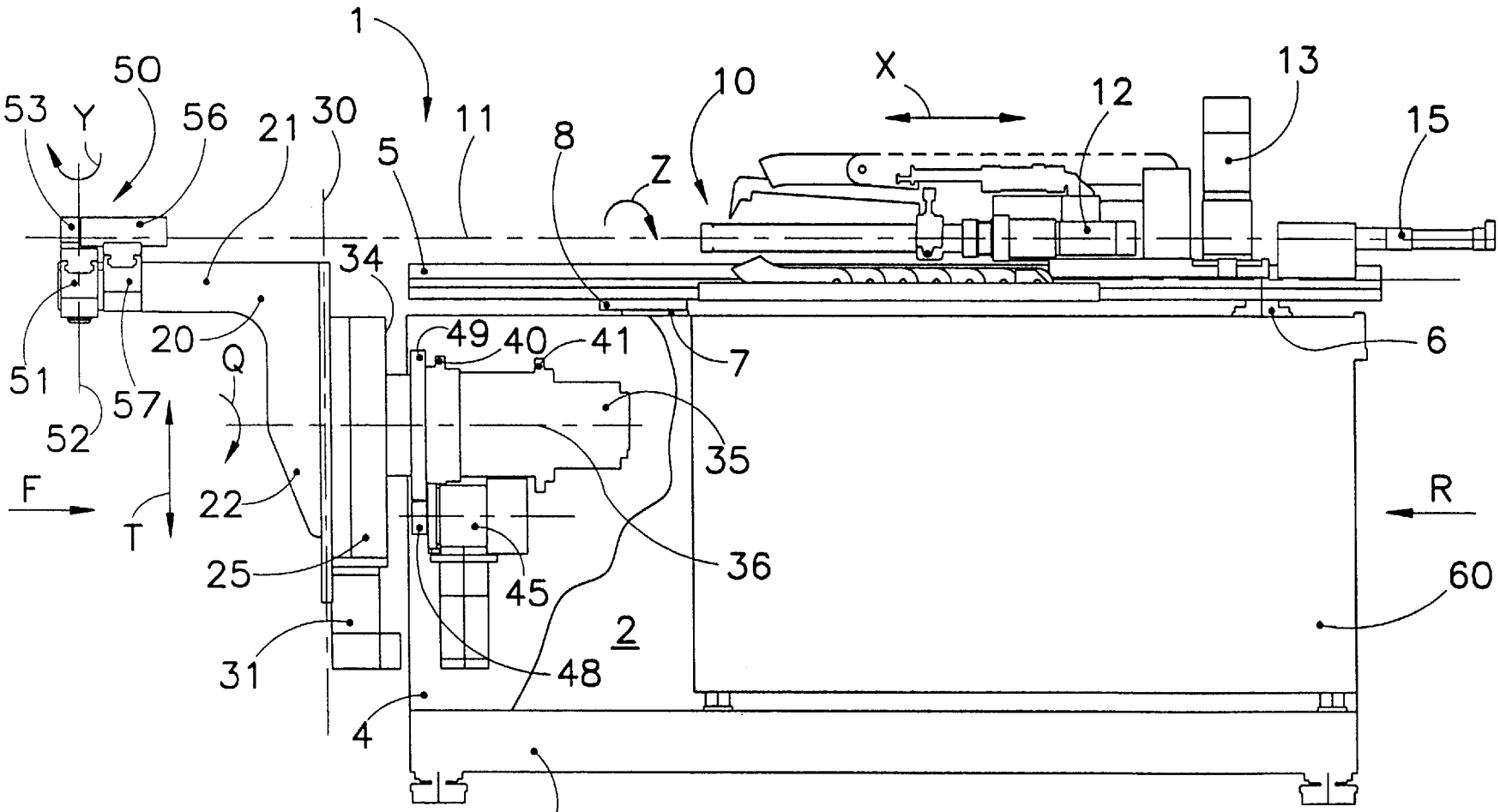
FIG. 1 is a schematic side view, as partially sectioned, illustrating a bending machine.
Figure 2:
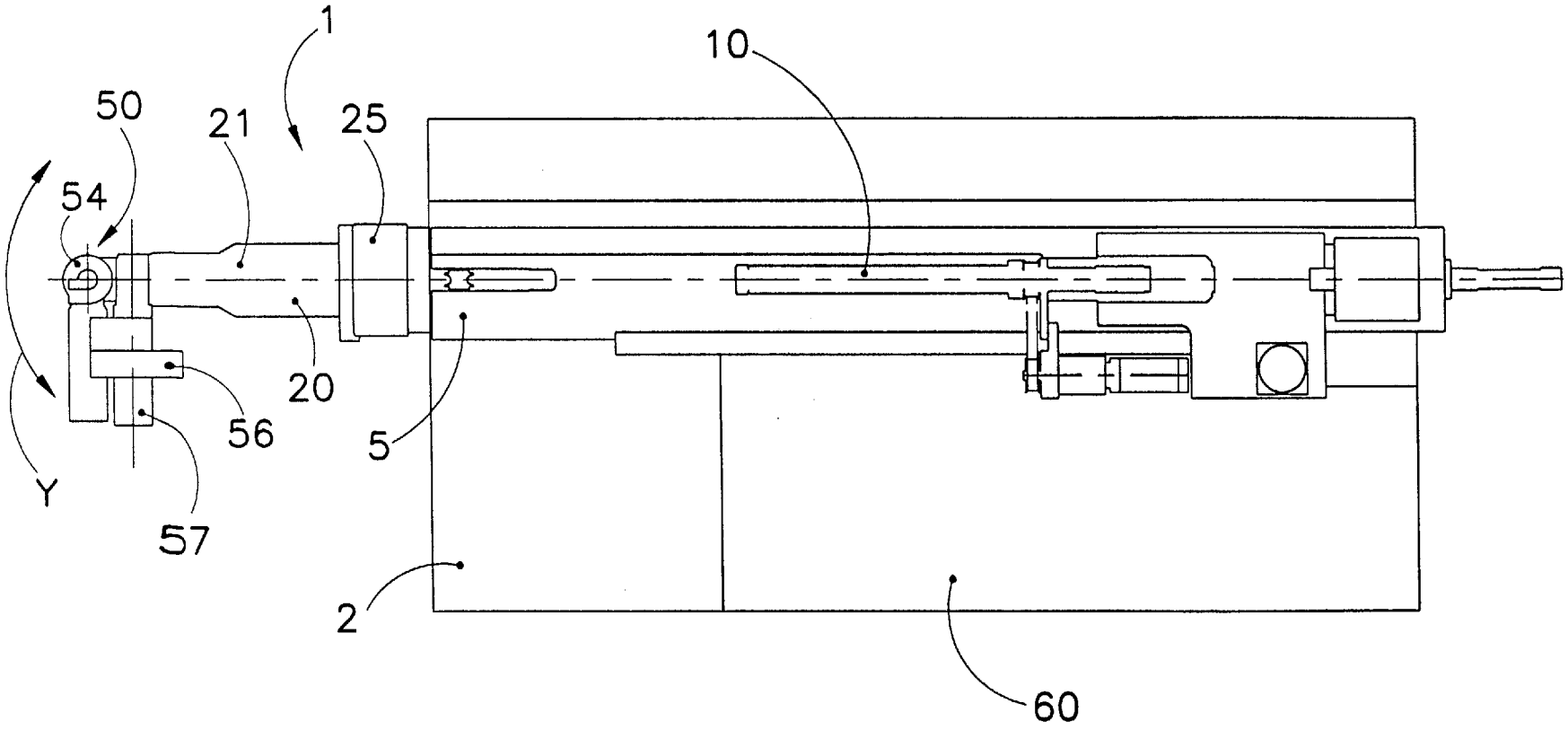
FIG. 2 is a schematic top plan view of a bending machine.
Figure 3:
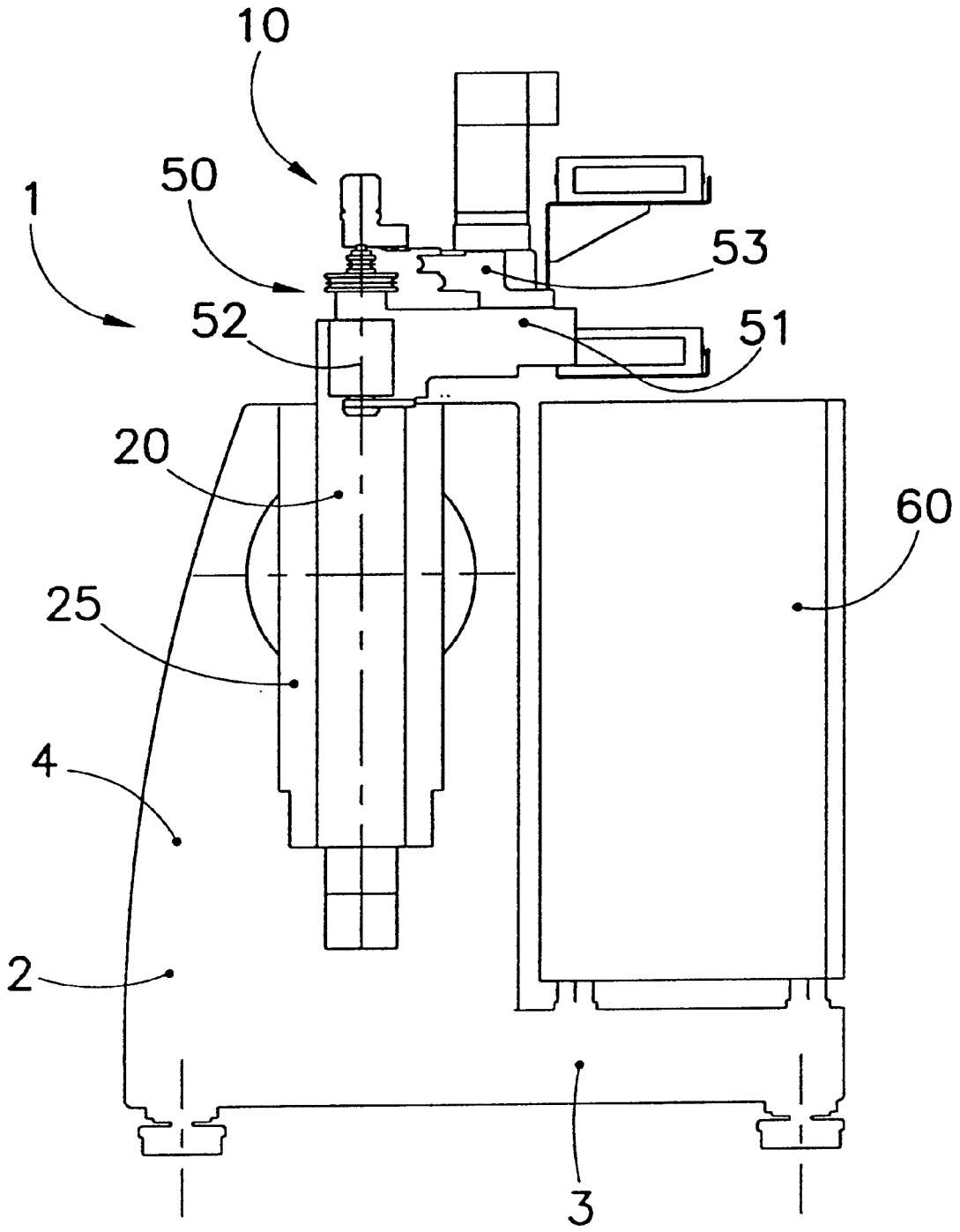
FIG. 3 is a schematic front view of the bending machine, with the head thereof arranged in a vertical position.

FIGS. 1, 2 and 3 illustrate the main component elements forming a bending machine, generally indicated by 1.

The machine bed 2, having an elongated prismatic body, is provided with a substantially L-shape cross section and is arranged on a side 3 of the L-shape, the second side 4 thereof being vertically directed.

The two ends of the elongated prismatic body define a front (according to the arrow F) and a rear (according to the arrow R) and, accordingly, a front portion of the machine 1 (facing the front) and a rear portion thereof (facing the rear).

A plate 5 for example of rectangular configuration in top plan view, is provided on the top of the vertical side 4 of the machine bed 2.

A vertical axis pin 6, provided in the rear portion of the machine bed 2, operatively connects the plate 5 to the machine bed 2.

On the top of the vertical side 4 of the machine base 2 guides 7 coupled to shoes 8 provided on the bottom of the plate 5 are provided.

The plate 5 can swing about the pin 6 from an equilibrium position longitudinally aligned with the machine bed 2. Resilient return means (not shown) cause the carriage 5 to return, as urged, to its equilibrium position.

A gripper for gripping and locating rod or pipe lengths (not shown), generally indicated by 10, is arranged on a carriage supported by the plate 5.

Clamping means (not shown) of the gripper 10 define an axis 11 thereon the straight length to be bent is arranged.

The gripper 10 is longitudinally coupled to the plate 5 for example by guides (not shown) parallel to the axis 11 of the gripper 10.

To the gripper 10 and carriage are operatively coupled servomotors 12, 13.

Said servomotors 12, 13 allow to adjust the angular position of the gripper 10 about the axis 11 (according to the arrow Z) and the feeding of the carriage on the plate 5 (according to the arrow X).

On the rear of the plate 5 a known type of ejector, generally indicated by 15, aligned with the axis 11 of the gripper 10 is provided.

On the front of the machine bed 2, a slide 20 is arranged.

The slide 20 comprises, for example, a L-shape body having a side 21 thereof substantially parallel to the axis of the gripper 10. A second side 22 thereof is operatively coupled to a table 25 facing the front of the machine bed 2.

Sliding guides (not shown) for the slide 20 are provided on the table 25, as transversely arranged of the axis 11 of the gripper 10, and define a slide 20 translating axis 30 (according to the arrow T).

A servomotor 31, supported by the table 25, adjusts the translation of the slide 20 on the table 25. For example, said servomotor 31 is coupled to a ball circulation screw (not shown) aligned with the slide 20 sliding guides and including a nut screw (not shown) fixed to the slide 20 coupling side 22.

A shaft 35 extends from the surface 34 facing the bed 2 of the table 25, in parallel with the axis 11 of the gripper 10.

The axis 36 of the shaft 35 defines a turning or rotary axis of the table 25 (according to the arrow Q).

The shaft 35 is arranged, for the most part thereof, inside the body of the vertical side 4 of the machine base 2.

Supporting and rotary means 40, 41, such as falling or sliding bearings, connect the shaft 35 to the body of the bed 2.

A servo-aided geared motor 45 is provided inside the body of the bed 2 and is coupled to the shaft 35.

For example, said geared motor 45 is provided with a pinion 48 coupled to a gear wheel 49 keyed on the shaft 35.

Likewise, it is possible to rotatively support the slide 20 on a table and to support said table, in a translating manner, on the machine bed 2. This solution, however, is not very advantageous. In fact, the elements allowing the slide 20 to turn must have a high constructional stiffness and, accordingly, a large size, which are not compatible with a desired reduced size for the table. On the contrary, if the elements allowing the slide to turn are arranged between the table and machine bed, such as the supporting shaft 35, then no size limit is imposed to these elements and the supporting and driving means therefor.

A known bending head, generally indicated by the number 50, is arranged at the end of the side 21 parallel to the axis 11 of the gripper 10.

The bending head 50 comprises an arm 51 which can be driven to swing (according to the arrow y) about a pivot pin (not shown) perpendicular to the axis 11 of the gripper 10. The pivot pin defines the bending axis 52 of the bending machine 1. Known types of dies 54 are received in the bending pin.

A slide 53 for clamping the rod or pipe length being machined is provided on the arm 51.

A further roller abutment slide 56 is slidably provided on an arm 57 fixed to the slide 20 transversely of the axis 11 of the gripper 10.

Advantageously, the slide 20 can have a slide body of U or T-shape, for example, having a sufficient constructional stiffness for the bending operations and provided with a table 25 coupling surface oriented transversely of the gripper 10 axis 11 and one or more supporting ends for one or more bending heads 50 arranged with their axis 52 perpendicular to the gripper axis 11.

Advantageously, the slide 20 which, owing to the table 25, can rotate about an index axis 36 (according to the arrow Q), can support several machining units arranged circumferentially on the body of the slide 20 so as to present themselves, as the table 25 is turned, in alignment of the gripper 10 axis 11 in order to machine the rod or pipe length.

For example, it is possible to provide the slide with a U-shape body. The thus made slide could support a bending head at the end of a first leg of the U-shape, as well as a butting unit at the end of the second leg thereof. Advantageously, the slide 20 can translate according to two axes transversal of the gripper 10 axis 11.

For example, the supporting and rotary means 40, 41 for supporting and turning the shaft 35 of the table 25 and the geared motor 45 are supported by a translating carriage (not shown) housed in the machine bed and driven by a servo-actuator. The table 25 driving carriage is coupled to guides (not shown), rigid with the body of the machine bed 2 and transversal of the axis 11 of the gripper 10.

The driving and control units for the servomotors 12, 13, 31, 45 driving the axes 11, 30, 35, 52 of the bending machine 1 are housed in a cabinet 60 supported on the rear of the machine bed 2. The cabinet 60 is housed in the space provided by the L-shape of the machine bed 2, while allowing the front portion of the machine bed 2 near the slide 20 free and disengaged.

The driving units are coupled to a known type of digital control unit (not shown).

Known types of sensors (not shown) arranged on several driving elements of the bending machine 1, provide a feedback control for the digital control unit.

Figure 4:
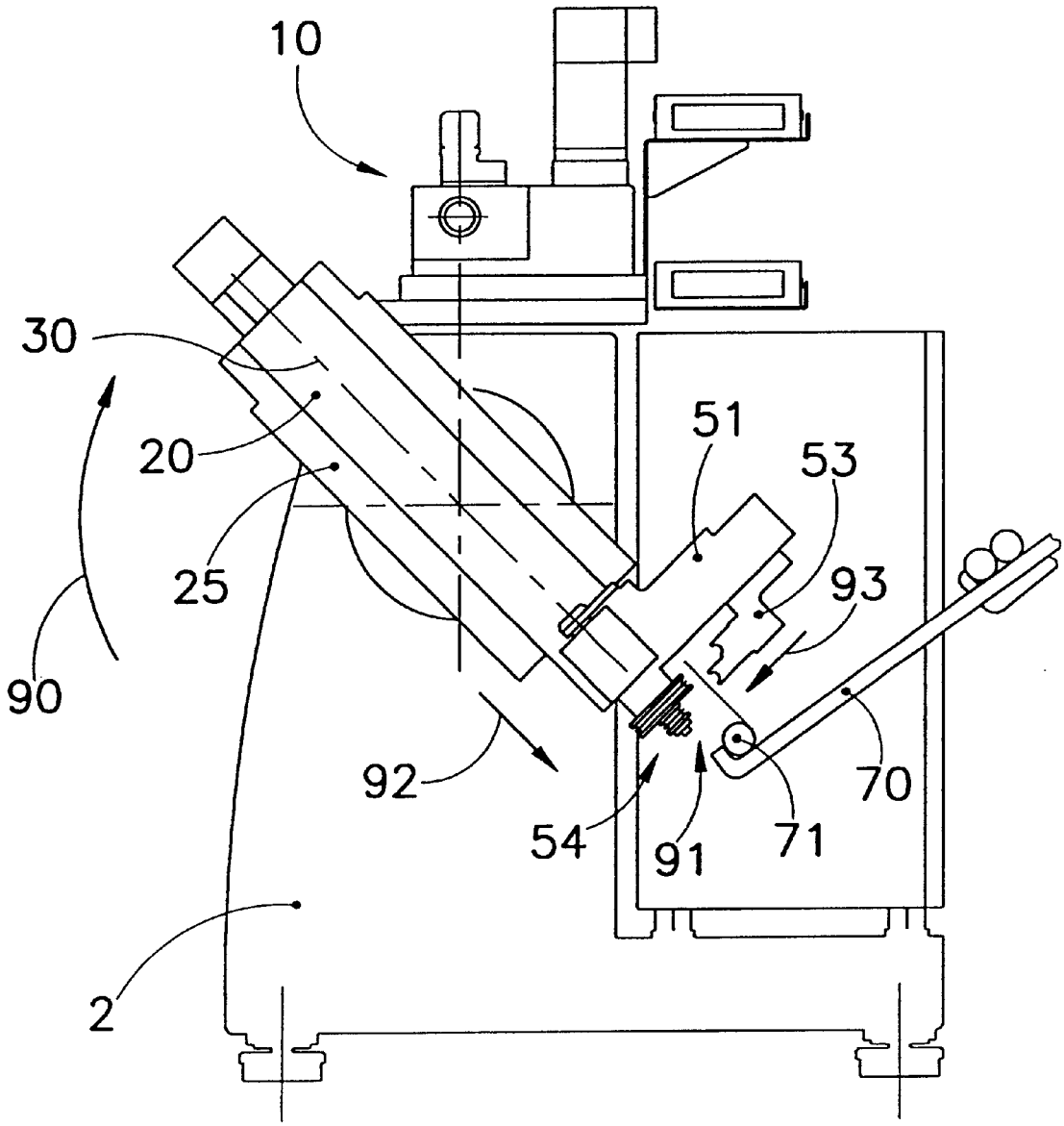
FIG. 4 is a schematic front view of a bending machine, with the slide thereof facing downwardly.
Figure 5:
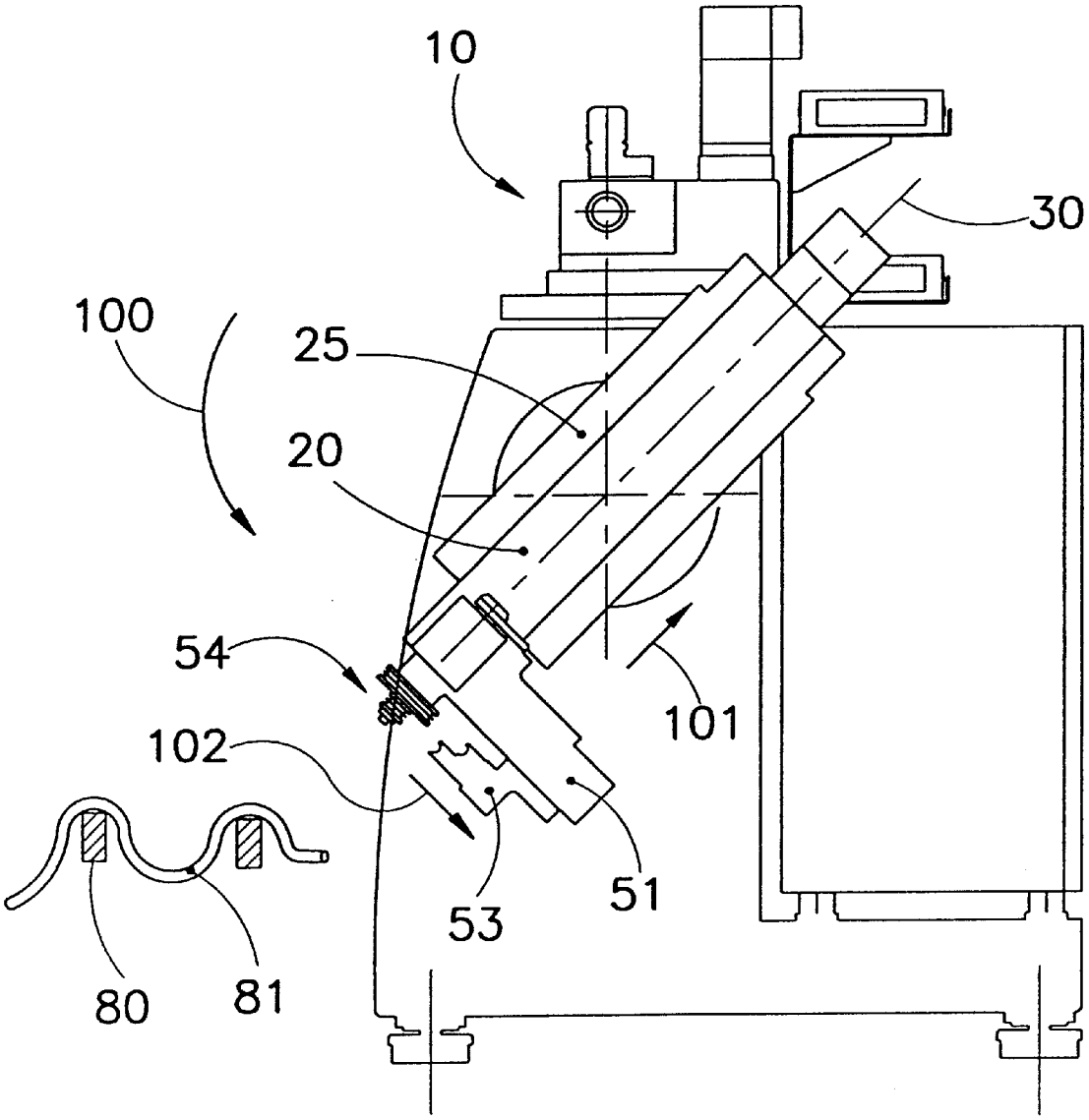
FIG. 5 is a further schematic front view illustrating a bending machine with the slide thereof facing a workpiece unloading unit.

With reference to FIGS. 4 and 5, the operation of the slide 20 will be thereinbelow disclosed.

To that end is considered an example in which the head 50 is used as a handling unit during an operating step in which a straight length 71 of rod, section member or pipe is taken from a loading station 70 and in which the head is used during an operating step in which a contoured length 81 is released to a unloading station 80.

By observing the bending machine from the front thereof, the table 25 (FIG. 4) is rotatively driven clockwise (in the direction of the arrow 90).

Then, the slides 53, 56 are moved away from the fully clamped position thereof contacting the die 54 thereby providing an opening 91. This opening 91 is aligned with the length 71 supported by a fork element of the loading station 70.

Then, the slide 20 is extended (in the direction of the arrow 92), so as to align the groove plane of the die 54 with the length 71. Then, the table 25 is anticlockwise driven to cause the length 71 to abut against the groove of the die 54.

Then, the slide 54 is frontward displaced (according to the arrow 93) so as to clamp the length 71 between the slide 53 and die 54.

The table 25 is then anti-clockwise rotatively driven, and the slide 20 is withdrawn so as to align the length 71 with the gripper 10 axis 11. Then, the gripper 10 is displaced frontwardly so as to grip the free end portion of the length 71.

Known bending operations are successively carried out.

After having contoured as desired the length 81, the gripper 10 releases the end portion thereof and is withdrawn on the plate 5 (FIG. 5). Then, the slide 20 will be anti-clockwise (according to the arrow 100) rotatively driven to cause the contoured length 81 to abut on a suitably designed unloading station 80.

Then, the slide 53 will be withdrawn (in the direction of the arrow 101) thereby disengaging the length 81. Successively, the table 25 will be clockwise rotatively driven thereby allowing the length 81 to exit the groove of the die 54 and the slide 20 will be withdrawn (in the direction of the arrow 102) thereby said slide 20 will be free of returning to the loading station 70.

Advantageously, the slide 20 will bring the contoured length 81 to one or more subsequent machining stations, such as drilling, butting or marking stations, provided within the handling volume accessible for the contoured length 81 clamped in the bending head 50 of the slide 20.

I claim:

1. A bending machine (1) for retrieving an elongated workpiece from a first station, bending said workpiece, and releasing said workpiece to a second station, said bending machine comprising:

a machine bed (2);

a rotatable gripper (10) mounted on said machine bed (2) and translatable along a gripper axis (11);

a rotatable supporting shaft (35) housed in said machine bed (2) and rotatable along a rotary axis (36) substantially parallel to said gripper axis (11);

a table (25) coupled to said supporting shaft (35);

a translating slide (20) coupled to said table (25) and being slidable along a translating axis (30) transverse to said rotary axis (11); and a bending head (50) supported by said translating slide (20) and comprising:

an arm (51) pivotable about a bending axis (52) substantially perpendicular to said gripping axis (11), and a movable slide (53) mounted on said arm;

wherein when said table (25) and translating slide (20) are in a first position, said movable slide (53) is controllable to clamp said workpiece to said bending head (50) and thereby retrieve said workpiece from the first station, and when said table (25) and translating slide (20) are in a second position, said movable slide (53) is controllable to unclamp and release said workpiece to the second station.

2. The bending machine of claim 1, wherein said supporting shaft (35) is supported by a translating carriage housed in the machine bed (2) and operatively coupled to driving and control means.

3. The bending machine of claim 1, wherein said table (25) comprises sliding guides for receiving said slide (20) and a driving screw coupled to a servomotor (31) and a nut screw rigid with the slide (20).

4. The bending machine of claim 1, wherein the shaft (35) extends from the table (25), and further comprising a supporting and rotary means (40, 41) connecting the shaft (35) to the machine base (2), and a rotary adjusting means coupled to the shaft (35).

5. The bending machine of claim 4, further comprising a servo-aided geared motor (45) supported by the machine base (2), a gear wheel (49) keyed on said shaft (35), and a pinion (48) coupling the geared motor (45) to said gear wheel (49).

6. The bending machine of claim 1, wherein a plurality of machining units are supported by the slide (20).

* * * * *